US007190310B2

(12) United States Patent
Masutani

(10) Patent No.: US 7,190,310 B2
(45) Date of Patent: Mar. 13, 2007

(54) ANTENNA APPARATUS

(75) Inventor: Takeshi Masutani, Moriguchi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/988,956

(22) Filed: Nov. 15, 2004

(65) Prior Publication Data

US 2005/0110689 A1 May 26, 2005

(30) Foreign Application Priority Data

Nov. 20, 2003 (JP) ..... 2003-390525
Jun. 1, 2004 (JP) ..... 2004-162860

(51) Int. Cl.
*H01Q 1/36* (2006.01)

(52) U.S. Cl. ..... 343/700 MS; 343/769

(58) Field of Classification Search ..... 343/700 MS, 343/769, 741, 748, 846, 713
See application file for complete search history.

(56) References Cited

U.S. PATENT DOCUMENTS 4,987,421 A * 1/1991 Sunahara et al. .... 343/700 MS
5,675,346 A * 10/1997 Nishikawa et al. .. 343/700 MS

FOREIGN PATENT DOCUMENTS

JP 4-88702 A 3/1992
JP 4-67363 B2 10/1992

* cited by examiner

*Primary Examiner*—Michael C. Wimer
(74) *Attorney, Agent, or Firm*—RatnerPrestia

(57) ABSTRACT

A ring electrode is disposed in a ring shape opposite to a grounded electrode in a flat shape at a predetermined distance therefrom. A connection member is disposed which is made up of impedance converting portion and transmission line portion, connected in series with impedance converting portion, between the inner side of ring electrode and feeding terminal. Thus, an antenna apparatus easy to achieve impedance matching thereof by use of a connection member can be economically realized.

6 Claims, 4 Drawing Sheets

ANTENNA APPARATUS

FIELD OF THE INVENTION

The present invention relates to an antenna apparatus for use in such apparatuses as vehicle-mounted mobile radio apparatuses.

BACKGROUND OF THE INVENTION

Recently, mobile radio apparatuses such as ETC (Electronic Toll Collection) systems have come into wide use. As antenna apparatus to be used in such radio apparatuses, there are proposed ring antenna apparatuses not employing an expensive dielectric substrate.

FIG. 5 is a perspective view of an example of such an antenna apparatus and FIG. 6 shows a circuit diagram of the same.

The conventional antenna apparatus is constructed of wiring substrate 40, ring electrode 43, and matching circuit 60, with, in addition, coaxial line 51 and signal circuit unit 50 connected to the same. Wiring substrate 40 has grounded electrode 41 made of copper foil formed on its top face and wiring pattern 45 in a predetermined shape formed on its rear side. Ring electrode 43 in a ring shape is supported by a plurality of supporting members 42 so as to oppose grounded electrode 41 at a predetermined distance from the same. Further, feeding terminal 44, which is provided to pass through wiring substrate 40 having grounded electrode 41 formed thereon, and ring electrode 43 are electrically connected at the position of connecting point 431 of ring electrode 43.

Matching circuit 60 has a function (hereinafter called "impedance matching") to allow a high-frequency signal to be transferred without loss from signal source 50 to ring electrode 43 via feeding terminal 44. Matching circuit 60 is made up of pluralities of coils 47 and capacitors 48 as electronic components for general purpose. Matching circuit 60 is connected with wiring pattern 45 on wiring substrate 40. Further, matching circuit 60 is connected to coaxial line 51 and coaxial line 51, in turn, is connected to signal circuit unit 50.

As shown in FIG. 6, matching circuit 60 is configured such that coil 47 is connected, in series, between signal source 50 and ring electrode 43, while capacitor 48 is connected, in parallel, at its one end with wiring pattern 45, disposed between coil 47 and connection point 451 with feeding terminal 44, and at its other end with grounded electrode 41. Incidentally, one end of wiring pattern 45 in connection with coil 47 is connected with coaxial line 51 at predetermined connection point 511 of wiring pattern 45. Further, the other end of feeding terminal 44 is connected to connection point 431 of ring electrode 43 as earlier mentioned.

When a radio wave is transmitted from the antenna apparatus in the above mentioned configuration, a high-frequency signal from signal circuit unit 50 is transferred by means of center conductor 52 and outer conductor 53 of coaxial line 51 and input to matching circuit 60 of the antenna apparatus. In matching circuit 60, impedance matching is performed, and the high-frequency signal passed through matching circuit 60 is transferred to ring electrode 43 and transmitted as a radio wave. When a radio wave is received, operations reverse to the above are performed so that a signal is received by signal circuit unit 50.

FIG. 7 is a Smith chart showing impedance matching characteristics. Description will be given below with use of the chart. Suppose now, for example, that the impedance of the antenna apparatus without matching circuit 60 inserted therein (hereinafter referred to as "initial impedance") is positioned at point 561 to the right of center point 55 (=50Ω) on the horizontal center line of the Smith chart. If, then, matching circuit 60 is inserted, the following change in the situation occurs. Namely, by virtue of matching circuit 60 formed of coil 47 and capacitor 48, the impedance makes rotational movement in a clockwise direction along the circumference of what is called constant-conductance circle in the Smith chart to change its position to point 562. Then, from the position of point 562, it further makes rotational movement in the clockwise direction along the circumference of what is called constant-resistance circle to change its position to center point 55 (=50Ω) and, thus, impedance matching is achieved.

In such conventional antenna apparatuses, matching circuit 60 for impedance matching is made up of capacitors and coils as the electronic components for general-purpose. However, such capacitors and coils have predetermined stepped values. As a result, in order to achieve proper matching with use of such electronic components having predetermined stepped values, it is necessitated to use pluralities of capacitors and coils. Hence, there has been a problem that the number of components forming matching circuit 60 increases.

In view of the problem, there is disclosed a loop antenna for circularly polarized wave In Japanese Patent No. H04-67363. This antenna has a grounding plate and a loop conductor, provided with precession elements for emitting circularly polarized wave, arranged to oppose each other with a dielectric member sandwiched therebetween. Further, there is provided an L-shaped element extending a predetermined distance from a predetermined position of the loop conductor toward the interior of the loop, while the center conductor of a power supplying coaxial line is connected to the L-shaped element and the outer conductor of the same is connected to the grounding plate. Although this antenna apparatus is not using a capacitor or coil as an electronic component for general purpose, it is using a dielectric substrate. Hence, it is considered relatively difficult to manufacture this apparatus at low cost.

Further, in Japanese Patent Unexamined Publication No. H04-88702 is disclosed a configuration, in a matching circuit for an antenna to be interposed between a narrow band antenna and a power supplying wire to thereby match the antenna with the power supplying wire over a wide band, having a first standard impedance wire with a predetermined length disposed on the side of the antenna, having a second low impedance wire with a predetermined length and a third high impedance wire with a predetermined length serially connected, in series, to the standard impedance wire, and, further, having a second low impedance wire with a predetermined length connected, in series, to the high impedance wire on its side toward the power supplying wire. This configuration is also not using a capacitor or coil as an electronic component for general purpose, and provides an antenna apparatus of simple structure and small size. However, it seems to be a problem with this type that it, due to its configuration, becomes high-profiled as an antenna apparatus.

The present invention has been made to solve such problems with conventional types and, accordingly, it is an object of this invention to provide an antenna apparatus not requiring a capacitor or coil as an electronic component for general purpose, allowing precise adjustment of the impedance matching to be made easily, and being inexpensive.

SUMMARY OF THE INVENTION

To attain the above mentioned object, the antenna apparatus of the present invention comprises:

a grounded electrode in a flat shape;

a ring electrode in a ring shape disposed opposite to the grounded electrode at a predetermined distance therefrom;

a feeding terminal insulated from the grounded electrode and set upright thereon; and a connection member for electrically connecting the feeding terminal with the ring electrode, in which the connection member is formed of an impedance converting portion arranged to turn around the feeding terminal and having one end thereof connected to the feeding terminal and a transmission line portion having one end thereof connected to the other end of the impedance converting portion and having the other end thereof connected to the ring electrode.

By virtue of the described configuration, an antenna apparatus allowing impedance matching thereof to be achieved easily and being economical can be realized and it is useful for application to such apparatuses as vehicle-mounted mobile radio apparatuses.

DETAILED DESCRIPTION OF THE EXEMPLARY EMBODIMENTS

Below will be described exemplary embodiments of the present invention in detail with reference to the accompanying drawings. Incidentally, like elements may be denoted by like reference marks in the following and duplicate description of such elements may sometimes be omitted.

FIRST EXEMPLARY EMBODIMENT

Figure 1:
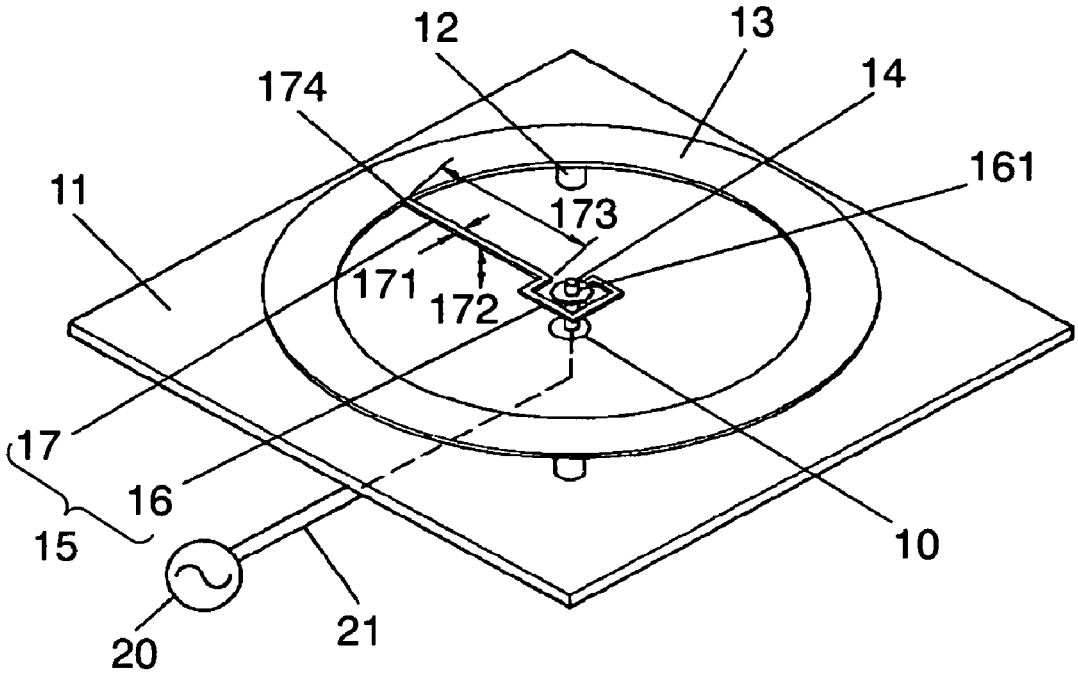
FIG. 1 is a perspective view of an antenna apparatus according to a first exemplary embodiment of the present invention.
Figure 2:
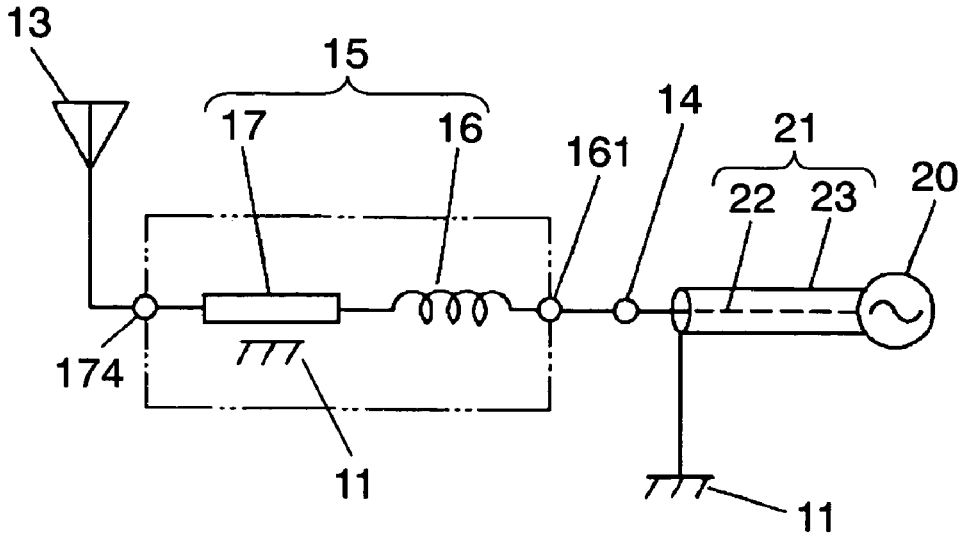
FIG. 2 is a circuit diagram of the antenna apparatus of the same embodiment.

An antenna apparatus according to a first exemplary embodiment of the present invention will be described below with reference to FIG. 1 and FIG. 2. FIG. 1 is a perspective view of the antenna apparatus according to the first exemplary embodiment of the present invention and FIG. 2 is a circuit diagram of the antenna apparatus. The antenna apparatus is mainly formed of grounded electrode 11 made of a flat metal plate, ring-shaped ring electrode 13 held a predetermined distance apart from grounded electrode 11, feeding terminal 14, and connection member 15 having a function of an impedance matching circuit, and to the same are connected coaxial line 21 and signal circuit unit 20.

Ring electrode 13 is supported by a plurality of supporting members 12 made of an insulating material so as to be held at a predetermined distance from grounded electrode 11 and disposed to confront grounded electrode 11.

Ring electrode 13 is made, for example, of a copper alloy material conducting electricity well, such as phosphor bronze. Further, the length of the circumference of a circle passing through the center of the ring width of ring electrode 13 is set at a size of $\lambda/\pi$, where $\lambda$ is the wave length of the received and transmitted radio wave and $\pi$ is the ratio of the circumference of a circle to its diameter.

Feeding terminal 14 is supported by insulator 10 passing through grounded electrode 11, one end thereof being directly connected to coaxial line 21 connected with signal circuit unit 20 and the other end thereof being electrically connected to end 161 of impedance converting portion 16 as a constituent of connection member 15. Coaxial line 20 is made up of center conductor 22 and outer conductor 23, of which center conductor 22 is connected with feeding terminal 14 and signal circuit unit 20 and outer conductor 23 is connected with grounded electrode 11.

Connection member 15 is formed integral with ring electrode 13 and disposed on the same plane that has ring electrode 13 disposed thereon. Connection member 15 is made up of impedance converting portion 16 spirally turning around feeding terminal 14 and having its end 161 connected to feeding terminal 14 as mentioned above and transmission line portion 17 in a linear form having its one end connected to the termination end of impedance converting portion 16 and having the other end 174 connected to a predetermined position on the inner circumference of ring electrode 13. Connection member 15 has a function of a matching circuit for performing impedance matching to transmit a high-frequency signal from signal circuit unit 20 to ring electrode 13, through feeding terminal 14, without loss. For convenience of explanation, the same element may hereinafter be called connection member 15 on some occasions, or matching circuit 15 on others. Impedance converting portion 16 is formed of a coil as shown in the drawing. The structure in series connection of this coil and the characteristic impedance of transmission line portion 17 is connected in series between signal circuit unit 20 and ring electrode 13, and, thus, connection member 15 also functions as a matching circuit for achieving impedance matching therebetween.

Here, transmission line portion 17 is a transmission line for transmitting a high-frequency wave, and it is what is called transmission component forming distributed constant circuits between its span from input to output terminals and grounded electrode 11, thereby offering a specific characteristic impedance. In the case of transmission line portion 17 shown in FIG. 1, for example, the characteristic impedance has a value determined univocally by such factors as conductor width 171 and distance 172 between transmission line portion 17 and grounded electrode 11. Further, transmission line portion 17 produces, in accordance with its length, a specific delay effect on the high-frequency signal transmitted therethrough. By such a delay effect and the like, the impedance of the antenna apparatus rotationally moves in a clockwise direction from the initial impedance value on the Smith chart.

In the above mentioned configuration, transmission of a radio wave from the antenna apparatus is done in the following manner. Namely, the high-frequency signal from signal circuit unit 20 is transmitted by center conductor 22 and outer conductor 23 of coaxial line 21 and input to connection member 15 through feeding terminal 14. While impedance matching is offered in connection member 15, the signal is transferred to ring electrode 13 and transmitted as a radio wave. When, on the other hand, a radio wave is received, the signal reception is done through processes reverse to the above mentioned transmission processes.

Figure 7:
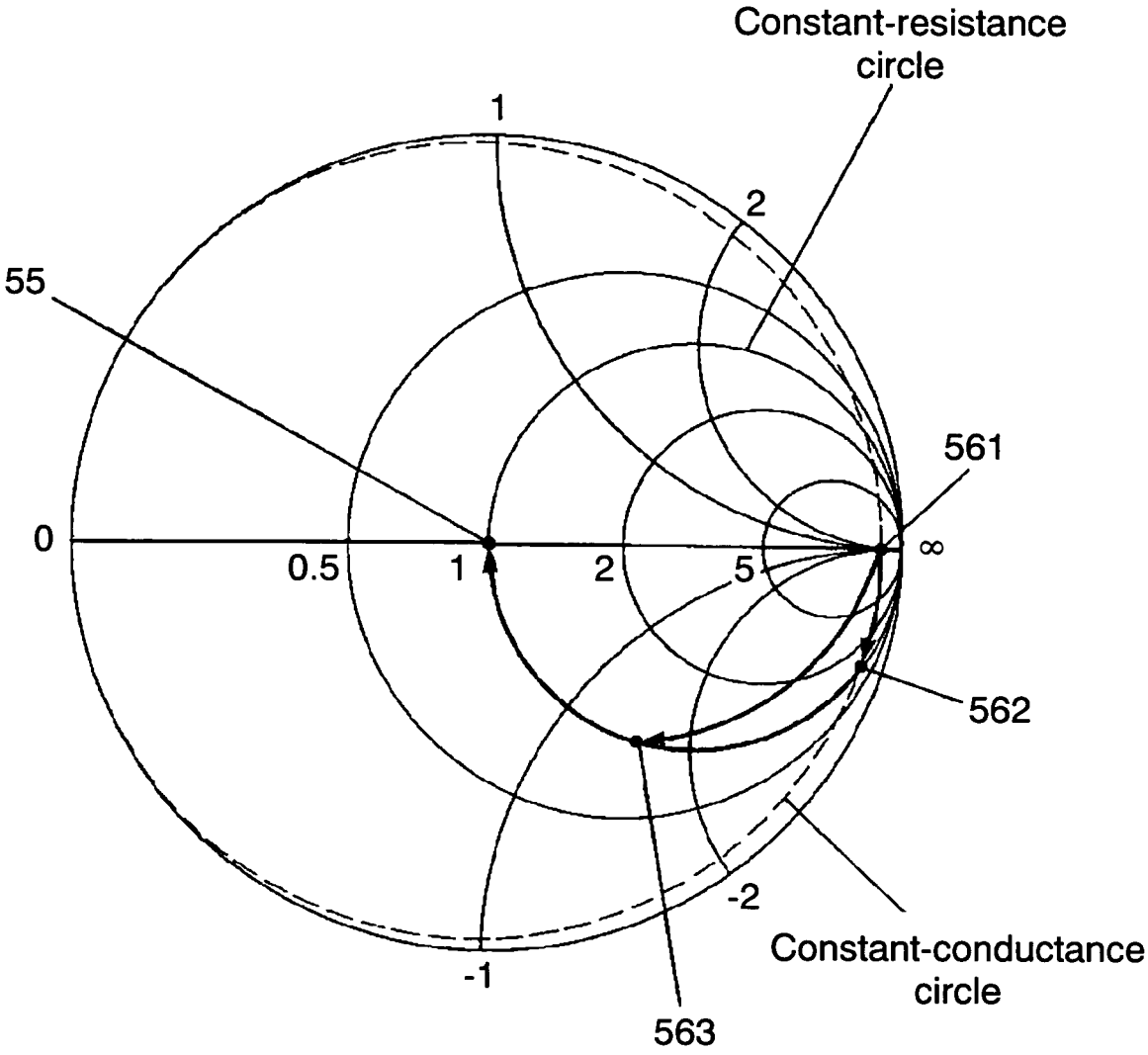
FIG. 7 is a Smith chart showing impedance matching characteristics.

The above processes will be described with use of the Smith chart shown in FIG. 7. Suppose now that the initial impedance of the antenna apparatus when connection member 15 as a matching circuit is not inserted therein is positioned, for example, at point 561 to the right of center point 55 (=50Ω) of the Smith chart. If, then, connection member 15 is inserted, following changes in conditions occur. Namely, the impedance of the antenna apparatus makes a clockwise rotation on the Smith chart and changes its position from the initial impedance at point 561 to center point 55 on the Smith chart. This movement is caused by action of the coil as impedance converting portion 16 and the characteristic impedance of transmission line portion 17 of matching circuit 15 and, thus, the impedance matching is achieved.

For example, if it is assumed that length 173 of transmission line portion 17 is 7 mm, conductor width thereof is 0.2 mm, and distance 172 between transmission line portion 17 and grounded electrode 11 is 3 mm, then the value of the characteristic impedance of transmission line portion 17 becomes approximately 240Ω. Since this value is greater than 50Ω, the impedance of the antenna apparatus makes a rotational movement clockwise while making orbit correction, under the influence of the characteristic impedance, toward the interior of the circumference of a circle, the diameter thereof is the length connecting center point 55 of the Smith chart with the point of infinite impedance (∞), to change its position to point 563. The impedance further makes a clockwise rotation from point 563 by action of the coil as impedance converting portion 16 of matching circuit 15 to reach the position of center point 55 (=50Ω) of the Smith chart, and thus the impedance matching is achieved.

According to the present embodiment as described above, a matching circuit for achieving the impedance matching is formed only by connection member 15 electrically connecting feeding terminal 14 with ring electrode 13. Thus, an optimum matching constant can be determined with ease and a good impedance matching can be provided. Further, the need for electronic components for general purpose such as capacitors and coils can be eliminated and an economical antenna apparatus becomes obtainable.

The characteristic impedance can be set at an optional designed value by suitably selecting such factors as line length 173, conductor width 171, and distance 172 from grounded electrode 11 of transmission line portion 17. Thereby, the constant of coil as impedance converting portion 16 can be reduced, hence the number of turns of impedance converting portion 16 can be reduced. Therefore, impedance converting portion 16 can be made lighter in weight and it becomes unnecessary to add supporting members and the like.

Further, since the circumferential length of the circle running along the center line of the ring width of ring electrode 13 is set at $\lambda/\pi$, where $\lambda$ is the wavelength of the transmitted or received radio wave and $\pi$ is the ratio of the circumference of a circle to its diameter, the initial impedance comes to be substantially constituted only of resistance component. This also makes the impedance matching easier.

If, here, the circumferential length of the circle running along the center line of the ring width of ring electrode 13 is set smaller than $\lambda/\pi$, then, the initial impedance becomes unable to be constituted only of resistance component. Therefore, the impedance comes to be deviated from a position on the center horizontal line of the Smith chart to be shifted to a position to an upper right position (not shown) on the Smith chart. In order to achieve the impedance matching from this position, the value of the coil component of connection member 15 is required to be increased. Hence, it becomes necessary to increase the number of turns of impedance converting portion 16 or to enlarge the line length 173 of transmission line portion 17. As a result, it becomes difficult to form connection member 15 as the matching circuit in the interior of ring electrode 13.

Further, by having connection member 15 formed integral with ring electrode 13 and disposed on the same plane that ring electrode 13 is disposed thereon, connection member 15 and ring electrode 13 can be manufactured at the same time, hence the antenna apparatus can be manufactured at low cost.

In the above exemplary embodiment, connection member 15 as the impedance matching circuit has been described as being constituted of impedance converting portion 16 and transmission line portion 17. However, as apparent from the above description, it is also possible to achieve impedance matching by forming connection member 15 of only either impedance converting portion 16 or transmission line portion 17 depending on the value of the initial impedance.

Although it has been stated above that impedance converting portion 16 is such that turns around feeding terminal 14 spirally, this turn does not necessarily mean one full turn, but it may be a turn less than one turn or more than one turn, as long as impedance converting portion 16 has a form or has a number of turns achieving impedance matching.

SECOND EXEMPLARY EMBODIMENT

Figure 3:
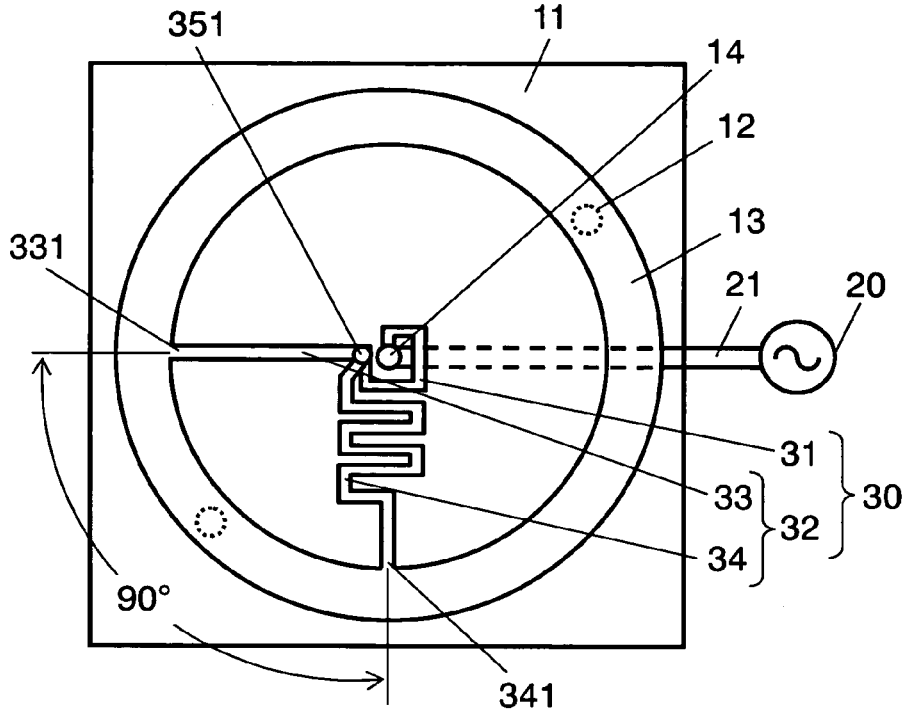
FIG. 3 is a plan view of an antenna apparatus according to a second exemplary embodiment of the present invention.

FIG. 3 is a plan view of an antenna apparatus according to a second exemplary embodiment of the present invention. The antenna apparatus of the present embodiment is characterized by that transmission line portion 32 of connection member 30 is constituted of first transmission line portion 33 and second transmission line portion 34.

Further, first transmission line portion 33 and second transmission line portion 34 each have one end thereof connected to termination point 351 of impedance converting portion 31. On the other hand, the other end 331 of first transmission line portion 33 and the other end 341 of second transmission line portion 34 are connected to ring electrode 13 such that their ends 331, 341 form an angle of substantially 90° therebetween.

Further, there is provided a difference between the electric length of first transmission line portion 33 and the electric length of second transmission line portion 34. Namely, the electric length of first transmission line portion 33 is from the other end 331 to termination point 351, while the electric length of second transmission line portion 34 is equally from the other end 341 to termination point 351. In FIG. 3, the electric length of second transmission line portion 34 is made longer than the electric length of first transmission line portion 33 by forming second transmission line portion 34 in a meandering shape.

By the way, there are two types of propagation of the radio wave, i.e., that of a linearly polarized wave in which the wave propagates with its direction of polarization fixed and that of a polarized wave in which the wave propagates with the direction of polarization rotating spirally (hereinafter called "circularly polarized wave"). For example, the linearly polarized wave is used in terrestrial television broadcasting and the like, while the circularly polarized wave is used for ETC and the like. Generally speaking, the circularly polarized wave is more excellent than the linearly polarized wave in short distance transmission where there are obstacles such as places between tall buildings. There are two types of circularly polarized waves, i.e., the right-handed circularly polarized wave which is rotated rightward while being propagated and the left-handed circularly polarized wave which is rotated leftward while being propagated.

The antenna apparatus of the present embodiment is capable of handling the circularly polarized wave. The example in which second transmission line portion 34 is larger than first transmission line portion 33 as shown in FIG. 3 is capable of handling the right-handed circularly polarized wave. When first transmission line portion 33 is made longer contrary to the above, it is capable of handling the left-handed circularly polarized wave.

More specifically, in the case of the antenna apparatus shown in FIG. 3, the other end 331 of first transmission line portion 33 and the other end 341 of second transmission line portion 34 constitute feeding points receiving their respective signals. For example, when signal transmission is performed by this antenna apparatus, because signals having a phase difference corresponding to the difference between the electric lengths are transmitted from termination point 351 to the feeding points, the antenna apparatus is rendered capable of handling a circularly polarized wave. In the case of signal reception, on the other hand, signal flows reverse to the above are produced and the received signals are transmitted to termination point 351 through the different electric lengths. More specifically, because a signal including a phase difference is transmitted to termination point 351, the antenna is rendered capable of handling a circularly polarized wave.

According to the present embodiment, transmission line portion 32 of connection member 30 is formed of first transmission line portion 33 and second transmission line portion 34 as mentioned above, and therefore, its impedance matching can be effectively achieved when the radio waves received and transmitted are circularly polarized.

Figure 4:
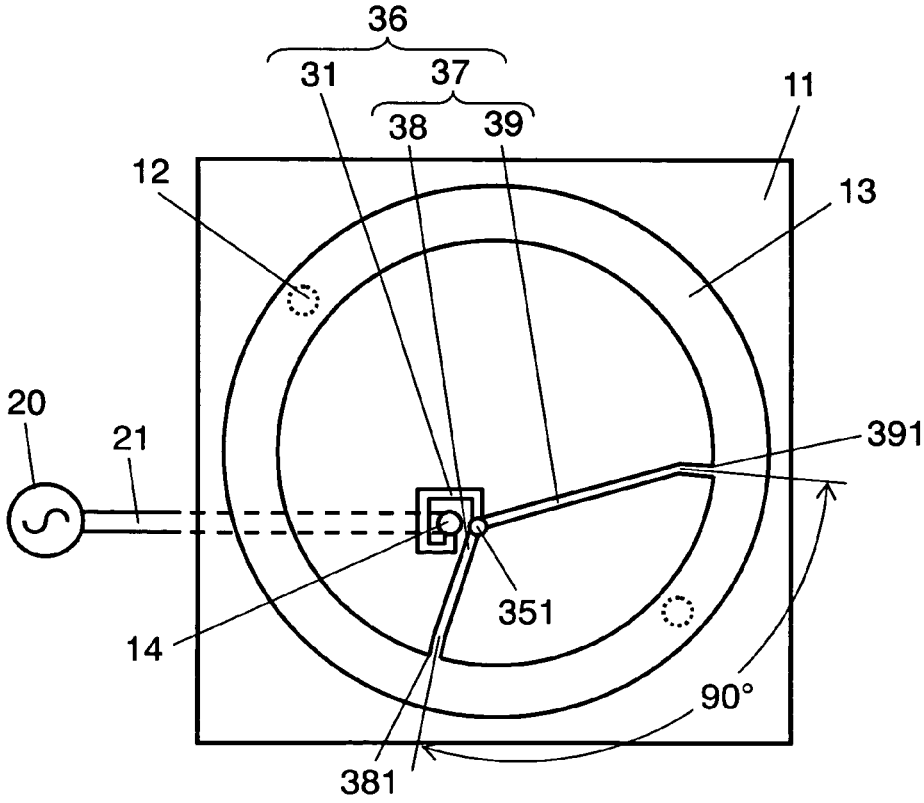
FIG. 4 is a plan view of an antenna apparatus as a modification of the embodiment.
Figure 5:
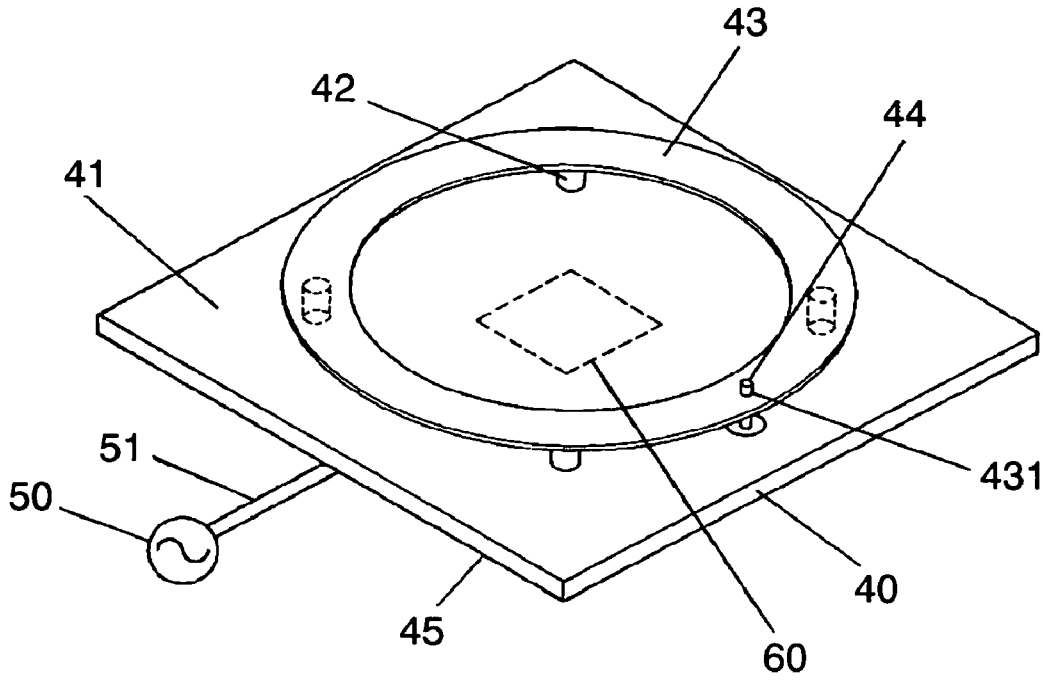
FIG. 5 PRIOR ART
FIG. 5 is a perspective view of an example of conventional antenna apparatus.
Figure 6:
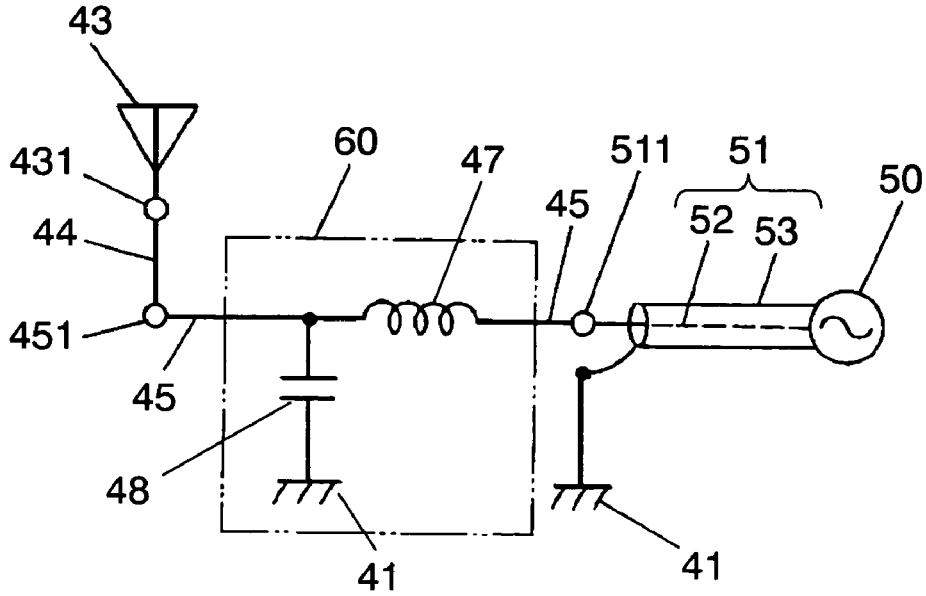
FIG. 6 PRIOR ART
FIG. 6 is a circuit diagram of the conventional antenna apparatus.

Although, in the present embodiment, feeding terminal 14 is disposed around the center of ring electrode 13, the invention is not limited to such a configuration. It may be configured, for example, as shown in FIG. 4. FIG. 4 is a plan view of a modification of the present embodiment. In the antenna apparatus shown in FIG. 4, feeding terminal 14 is disposed at a position shifted from the center of ring electrode 13. Connection member 36 is formed of impedance converting portion 31 and transmission line portion 37, and transmission line portion 37, in turn, is made up of first transmission line portion 38 and second transmission line portion 39. Further, as shown in FIG. 4, there is provided a difference between the lengths of the first and second transmission line portions from termination point 351 of impedance converting portion 31 to their respective other ends 381, 391 connected to ring electrode 13. Incidentally, the other end 381 of first transmission line portion 38 and the other end 391 of second transmission line portion 39 are connected to ring electrode 13 such that the other ends 381, 391 form an angle of 90° therebetween. Also with this configuration, the same characteristics as obtained in the antenna apparatus of FIG. 3 can be obtained.

Further, the transmission line portion 37 shown in FIG. 4 is not limited to one having a straight shape but it may have a meandering shape as shown in FIG. 3. While the difference between the electric lengths is required to be set at an optimum value in accordance with the operating frequency of the antenna apparatus, it, broadly speaking, may be set at ¼ or so of the operating frequency.

What is claimed is:

1. An antenna apparatus comprising:

a grounded electrode in a flat shape;

a ring electrode in a ring shape disposed opposite to the grounded electrode at a predetermined distance therefrom;

a feeding terminal insulated from the grounded electrode and set upright thereon; and a connection member for electrically connecting the feeding terminal with the ring electrode, the connection member including:

an impedance converting portion electrically connected in series with the feeding terminal and arranged to turn around the feeding terminal, and a transmission line portion electrically connected in series between the impedance converting portion and the ring electrode.

2. The apparatus according to claim 1, wherein a circumferential length of the ring electrode is determined according to a wavelength of a radio wave transmitted and received by the ring electrode divided by a ratio of a circumference of a circle to its diameter.

3. The antenna apparatus according to claim 1, wherein the connection member is formed integral with the ring electrode and disposed on a plane identical to a plane having the ring electrode disposed thereon.

4. The antenna apparatus according to claim 1, wherein the transmission line portion includes two transmission line portions electrically connected in parallel, and each of the two transmission line portions are connected at one end thereof to the impedance converting portion and at an other end thereof to the ring electrode such that a right angle is formed therebetween and a difference in electric length is provided therebetween.

5. The antenna apparatus according to claim 4, wherein a position of the feeding terminal is shifted from a center of the ring electrode so as to provide the difference in electric length.

6. The antenna apparatus according to claim 1, wherein the connection member matches an impedance between the feeding terminal and the ring electrode.

* * * * *